US006051811A

United States Patent [19]

Hardison

[11] Patent Number: 6,051,811

[45] Date of Patent: Apr. 18, 2000

[54] HEATED MAT ASSEMBLY FOR A DRIVEWAY

[76] Inventor: William Hardison, 20076 Lake Lynwood Dr., Lynwood, Ill. 60411

[21] Appl. No.: 09/032,899

[22] Filed: Mar. 2, 1998

[51] Int. Cl.[7] ..... H05B 1/00; E04H 15/64

[52] U.S. Cl. ..... 219/213; 135/119

[58] Field of Search ..... 219/211, 212, 219/213, 549; 135/120; 392/496

[56] References Cited

U.S. PATENT DOCUMENTS

| | | | |
|---|---|---|---|
| 3,680,472 | 8/1972 | Skelton et al. | 99/235 R |
| 3,725,638 | 4/1973 | Solin et al. | 219/213 |
| 4,246,982 | 1/1981 | Pretnick | 184/106 |
| 4,782,846 | 11/1988 | Ting | 135/120 |
| 4,967,057 | 10/1990 | Bayless et al. | 219/213 |
| 5,003,157 | 3/1991 | Hargrove . | |
| 5,233,164 | 8/1993 | Dicks et al. . | |
| 5,237,155 | 8/1993 | Hill . | |
| 5,371,340 | 12/1994 | Stanfield . | |
| 5,380,988 | 1/1995 | Dyer . | |
| 5,614,292 | 3/1997 | Saylor | 428/209 |
| 5,674,424 | 10/1997 | Iben et al. | 219/549 |
| 5,724,479 | 3/1998 | Takahashi | 392/496 |
| 5,763,858 | 6/1998 | Jones | 219/506 |
| 5,786,593 | 7/1998 | Tiburzi | 219/213 |

*Primary Examiner*—Teresa Walberg
*Assistant Examiner*—Daniel L. Robinson
*Attorney, Agent, or Firm*—Kenneth L Tolar

[57] ABSTRACT

The present invention relates to a heated mat assembly for preventing snow and ice accumulation on a driveway. The device comprises a substantially rectangular, rubber pad having planar upper and lower surfaces and four peripheral edges. Disposed between the upper and lower surfaces are a plurality of inner layers preferably constructed with a fiberglass cloth. Embedded within the inner layers are a plurality of heating elements in communication with a thermostat and power cord for selectively activating the heating elements upon the thermostat detecting a temperature below a predetermined value. Along the entire length of opposing edges of the pad are a pair of troughs for draining water from the upper surface directly onto a street. Adjacent each trough are a pair of straps having a grommet at a distal end thereof for receiving a fastener means to anchor the pad to the soil immediately adjacent the driveway. The device may remain connected during colder months and will only be activated when ambient temperatures fall below a predetermined value. When warmer months arrive, the device may be easily rolled up for storage.

7 Claims, 3 Drawing Sheets

HEATED MAT ASSEMBLY FOR A DRIVEWAY

BACKGROUND OF THE INVENTION

The present invention relates to a heated mat assembly, and more specifically, a heated mat for overlaying a driveway to minimize ice and snow accumulation thereon.

DESCRIPTION OF THE PRIOR ART

In areas having colder climates, snow and ice buildup on driveways has long been an extreme nuisance. If a vehicle is parked on a snow covered driveway, a driver sometimes must shovel significant amounts of snow in order to safely drive the vehicle. If the driveway is covered with ice, the vehicle owner may have little choice but to wait until the ice melts or must artificially melt it with hot water, salt or a similar substance. In either case, the ice will typically reappear. Although various heating assemblies for melting snow and ice exist in the prior art, none relate to an assembly which is uniquely configured to overlay a driveway. For example, U.S. Pat. No. 5,003,157 issued to Hargrove relates to a heated mat having a plurality of grooves on its upper surface for directing water towards arcuate sidewalls for drainage. The device is primarily designed to overlay pathways such as sidewalks.

U.S. Pat. No. 5,380,988 issued to Dyer discloses a plurality of heated mats electrically interconnected in parallel for attaching to exterior stairways. The mats are adhesively secured to a stair and each contain a metallic foil heating element.

U.S. Pat. No. 5,371,340 issued to Stanfield discloses a heating pad for pets and livestock having a plastic surface and an envelope containing a reflective insulation upon which is mounted an electric heating circuit. The device further includes a temperature sensitive switch that permits the flow of electricity only when the pad is below a predetermined temperature.

U.S. Pat. No. 5,237,155 issued to Hill discloses an electrical conductor formed in the shape of a cable harness and encased in a polymer cement block.

U.S. Pat. No. 5,233,164 issued to Dicks et al discloses a soil heating system comprising a plurality of parallel frame members rigidly connected to a series of support tubes perpendicular thereto. Each support tube encloses a heater element to protect it from air, water and contaminant vapors.

U.S. Pat. No. 4,697,057 issued to Bayless discloses a heated mat system each having male and female electrical connectors on the ends of power cords allowing any number of mats to be electrically interconnected to cover a flight of stairs.

Although heated mat assemblies exist in the prior art, none of these devices relate to a unitary mat dimensioned and configured to overlay a driveway. The present invention provides such a device that has longitudinal troughs on opposing sides thereof for directing moisture from the upper surface of the mat into the street and an attachment means for securing the mat to the driveway.

SUMMARY OF THE INVENTION

The present invention relates to a mat assembly for heating a driveway. The device comprises a substantially rectangular pad member having planar upper and lower surfaces and four peripheral edges. Both the upper and lower surfaces preferably relate to a neoprene rubber layer having interposed layers of fiberglass cloth with heating elements integral therewith. Adjacent the entire length of two opposing side edges of the pad member are a pair of troughs for receiving moisture generated by ice or snow melting on the upper surface. Adjacent each trough are a pair of straps having a grommet attached thereto for receiving an anchor means that penetrates the ground immediately adjacent the driveway to secure the assembly thereto. Also disposed within the pad member is a thermostat having a temperature sensor thereon which is in communication with each of the heating elements. Accordingly, the heating elements are selectively activated upon the thermostat detecting a temperature below a predetermined value. The heating elements and thermostat are powered with a standard electrical cord which may be plugged into an outdoor outlet. It is therefore an object of the present invention to provide a heated mat assembly uniquely configured to overlay a driveway.

It is yet another object of the present invention to provide a heated mat assembly which is selectively activated when the ambient temperature decreases to a predetermined value.

It is yet another object of the present invention to provide a heated mat assembly having an attachment means thereon for securing the device to a driveway.

It is yet another object of the present invention to provide a heated mat assembly having an integral drainage means for delivering water directly from the upper surface of the mat to a street. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
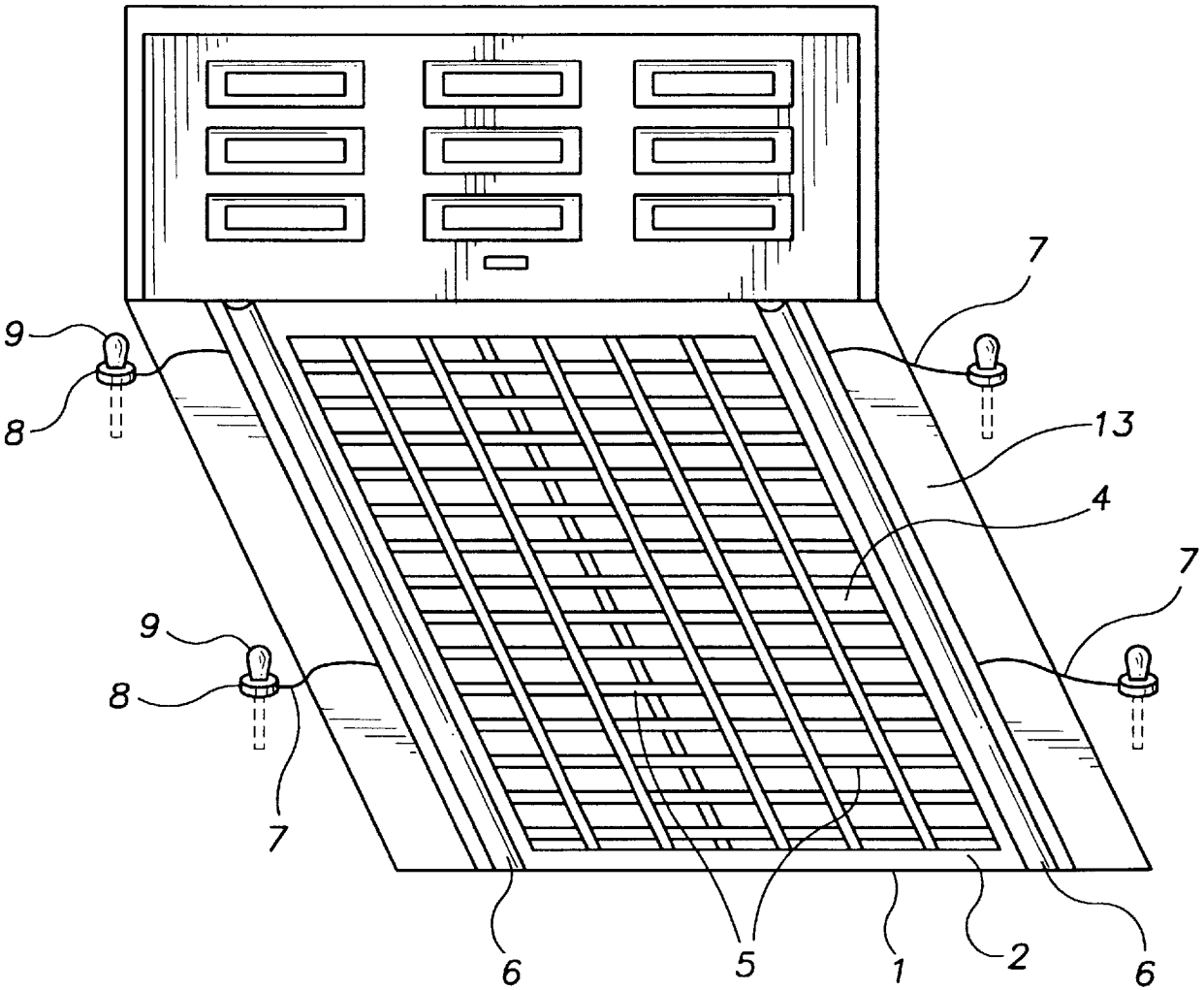
FIG. 1 generally depicts the inventive device overlaying a driveway and also provides a horizontal cross-sectional view of the upper surface with the heating elements therebelow.
Figure 2:
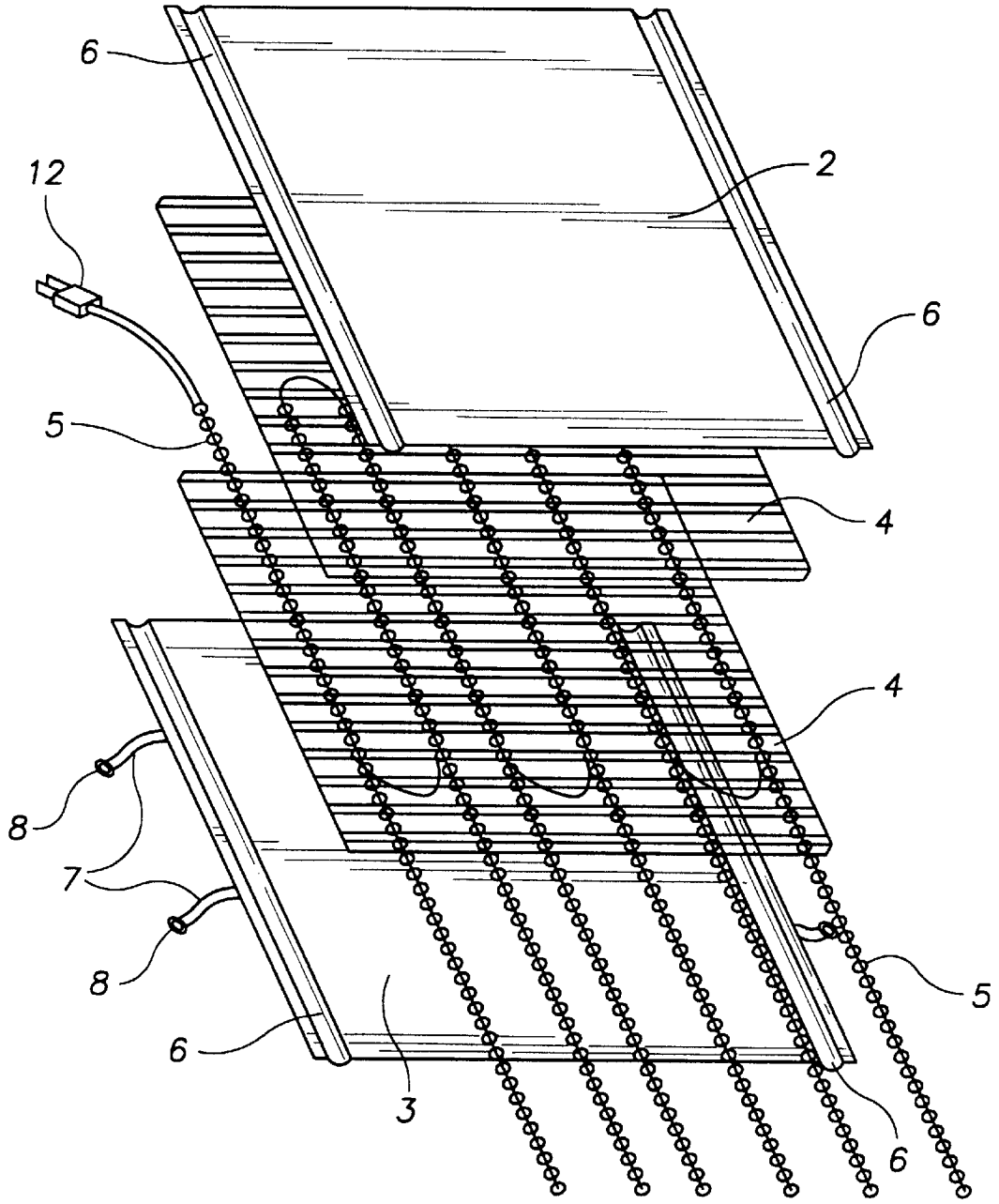
FIG. 2 is an exploded view of the inventive device.

Referring now to FIGS. 1 through 4, the present invention provides a heated mat assembly for preventing snow and ice accumulation on a driveway 13. The device comprises a substantially rectangular pad member 1 including planar upper 2 and lower 3 surfaces and four peripheral edges. The pad member 1 is dimensioned to overlay a substantial portion of the upper surface of a driveway having a predetermined dimension. The upper 2 and lower 3 surfaces are preferably made from neoprene rubber or a similar material. Disposed between the planar upper and lower surfaces are a plurality of inner layers 4 each preferably made from a fiberglass cloth. Imbedded between or integral with the inner layers are a plurality of heating elements 5. The inner layers protect and provide structural integrity to the heating elements 5 when a vehicle is resting on the upper surface of the pad member. The fiberglass layers also assist in evenly distributing heat generated by the heating elements to the upper surface of the pad.

Adjacent the entire length of each of two opposing longitudinal peripheral edges of the pad member is an integral trough 6 for receiving moisture generated by snow or ice melting on the upper surface. Adjacent each trough are a pair of straps 7 having a grommet 8 attached to a distal end thereof for receiving an anchoring means 9 such as a stake, bolt or similar device. Accordingly, the pad member may be secured to the upper surface of the driveway by inserting the anchoring means into the ground immediately adjacent opposing edges of the driveway.

Integrally disposed within the pad member is a thermostat 10 having a temperature sensor 11 thereon in electrical communication with each of the heating elements. Upon the thermostat detecting a temperature below a predetermined value, the heating elements will be selectively activated. Accordingly, the device will only be activated when needed and will be disabled during periods of warmer weather. The heating elements and thermostat are powered with a power cord 12 which may be plugged into an outdoor outlet.

Figure 3:
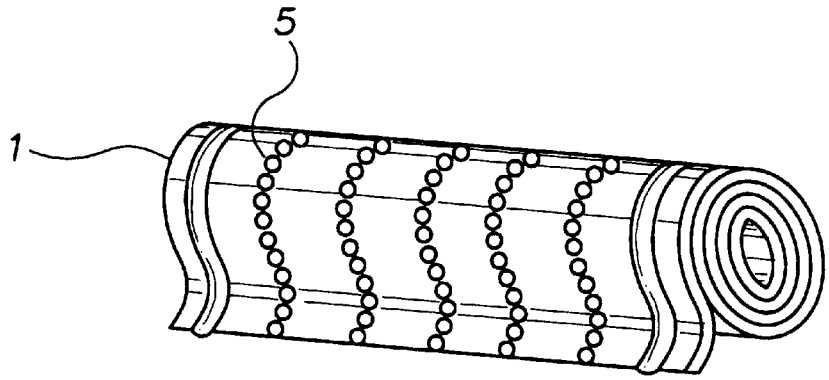
FIG. 3 depicts the mat assembly according to the present invention in a rolled position.
Figure 4:
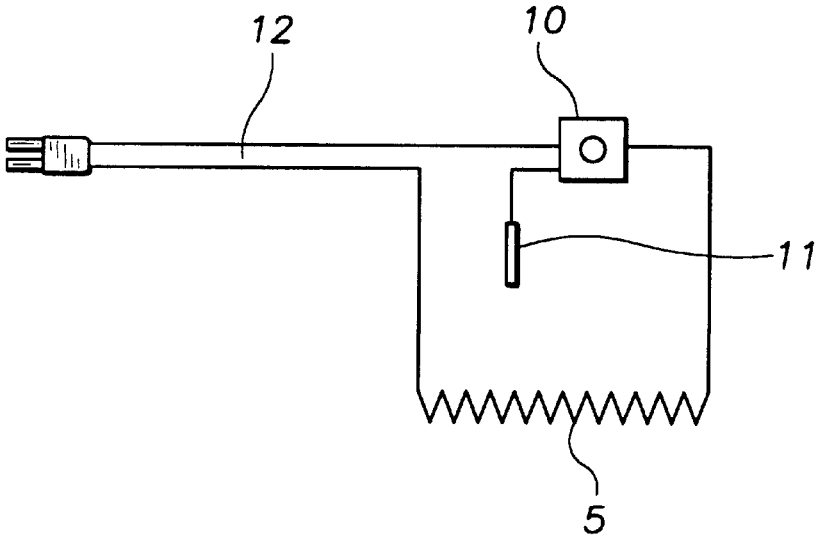
FIG. 4 depicts a wiring diagram of the heating element and thermostat according to the present invention.

To use the above described device, a user unrolls the pad over the top surface of the driveway 13 and secures the device by inserting an anchoring means 9 through each of the grommets 8 and into the soil adjacent the driveway. The electrical cord 12 remains electrically coupled with a standard electrical outlet at all times. Whenever the temperature is below a preselected value, preferably a temperature slightly above freezing, the heating coils 5 will be automatically activated thereby melting any snow or ice that contacts the upper surface of the pad. The water generated by the melting snow and ice will drain from the upper surface into the troughs where it will flow directly to the street thereby maintaining the driveway and surrounding soil free of excess moisture. During the warmer months when freezing is unlikely, the cord is unplugged and the pad is rolled up for storage as depicted in FIG. 3.

The above described device is not to be limited to the exact details of construction enumerated above. The heating elements may relate to fiberglass type style heating elements or any suitable equivalent. Although the outer layers are preferably constructed with neoprene rubber and the inner layers with fiberglass, any suitable material which may achieve the above stated objects of the present invention will suffice. As will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A heated mat assembly for a driveway comprising:

a substantially rectangular pad dimensioned to overlay a substantial portion of the upper surface of a driveway, said pad having planar upper and lower surfaces and two opposing side edges;

a plurality of inner layers disposed between said planar upper and lower surfaces;

a plurality of heating elements embedded within said inner layers;

an attachment means adjacent each side edge for securing the pad to the ground immediately adjacent a driveway;

said mat assembly further consisting of a pair of troughs integral with said pad, each trough adjacent to and extending along substantially the entire length of one of said side edges for draining water from the upper surface of said pad directly onto an adjacent roadway.

2. A heated mat assembly according to claim 1 further comprising a thermostat in communication with said heating elements for selectively activating said heating elements upon said thermostat detecting a temperature below a predetermined value.

3. A heated mat assembly according to claim 1 wherein said attachment means comprises a pair of straps adjacent each trough having a grommet at a distal end thereof for receiving a fastener means for anchoring said pad to the ground adjacent said driveway.

4. A heated mat assembly according to claim 1 wherein said inner layers are fabricated with a fiberglass cloth material to protect the heating elements and to evenly distribute heat generated thereby when a vehicle is resting on the upper surface of the pad.

5. A heated mat assembly according to claim 1 wherein said upper and lower surfaces are fabricated with a neoprene rubber material.

6. A heated mat assembly according to claim 1 wherein said heating elements and said thermostat are selectively powered with a power cord electrically connected thereto.

7. A heated mat assembly according to claim 1 wherein said heating elements relate to fiberglass, tape style heating elements.

* * * * *